US011319769B2

(12) United States Patent
Almalki et al.

(10) Patent No.: US 11,319,769 B2
(45) Date of Patent: May 3, 2022

(54) MULTI-INTERVENTION BLOWOUT PREVENTER AND METHODS OF USE THEREOF

(71) Applicant: SAUDI ARABIAN OIL COMPANY, Dhahran (SA)

(72) Inventors: Bandar S. Almalki, Dhahran (SA); Mohammed Yousef AlDaif, Dhahran (SA); Ali E. Aldossary, Dhahran (SA); Prasad Karunakaran, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/863,335

(22) Filed: Apr. 30, 2020

(65) Prior Publication Data

US 2021/0340832 A1 Nov. 4, 2021

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063
USPC ..... 251/1.1, 1.3
See application file for complete search history.

(56) References Cited

U.S. PATENT DOCUMENTS 2,609,836 A 9/1952 Knox
3,299,957 A * 1/1967 O'Neill ..... E21B 19/20 166/77.53
4,043,389 A 8/1977 Cobb
4,474,236 A * 10/1984 Kellett ..... E21B 33/047 166/250.08
4,685,521 A * 8/1987 Raulins ..... E21B 29/04 166/341

(Continued)

FOREIGN PATENT DOCUMENTS

EP 2808481 A1 12/2014
WO 2007/052082 A2 5/2007

(Continued)

OTHER PUBLICATIONS

International Search Report issued in corresponding International Application No. PCT/US2020/037140, dated Dec. 11, 2020 (3 pages).

(Continued)

*Primary Examiner* — Kevin F Murphy
*Assistant Examiner* — Jonathan J Waddy
(74) *Attorney, Agent, or Firm* — Osha Bergman Watanabe & Burton LLP

(57) ABSTRACT

A multi-intervention blowout preventer includes a body having a bore therethrough. A first pair of ram blocks may be coupled to the body and include a ram, a catcher, and a blade operationally connected to the bore via a first pair of openings in the body. The ram, the catcher, and the blade may cut a flexible line extending through the bore while holding the flexible line. A second pair of ram blocks may be coupled to the body and include a second pair of rams operationally connected to the bore via a second pair of openings in the body to seal around a tubular. A third pair of ram blocks may be coupled to the body and include a third pair of rams operationally connected to the bore via a third pair of openings in the body to seal the bore.

12 Claims, 8 Drawing Sheets

(56) References Cited

U.S. PATENT DOCUMENTS 4,726,424 A * 2/1988 Raulins ..... E21B 34/045 166/338
4,922,423 A * 5/1990 Koomey ..... E21B 33/063 166/373
5,280,823 A * 1/1994 Chabot ..... E21B 33/062 166/55
5,287,879 A 2/1994 Leggett et al.
5,727,640 A * 3/1998 Gleditsch ..... E21B 33/0355 175/7
5,961,094 A * 10/1999 Van Winkle ..... E21B 23/06 166/277
6,012,528 A * 1/2000 Van Winkle ..... E21B 23/06 166/339
6,321,846 B1 * 11/2001 Rytlewski ..... E21B 33/064 166/363
7,270,190 B2 * 9/2007 McWhorter ..... E21B 33/062 166/382
8,567,490 B2 10/2013 Van Winkle
8,905,129 B2 * 12/2014 Myers ..... E21B 40/00 166/250.01
9,869,149 B2 * 1/2018 Al-Badran ..... E21B 33/061
9,903,173 B1 2/2018 Nault et al.
2004/0124380 A1 * 7/2004 Van Winkle ..... E21B 33/06 251/1.3
2007/0119595 A1 * 5/2007 Carlsen ..... E21B 33/076 166/368
2010/0102263 A1 * 4/2010 Liew ..... E21B 29/04 251/326
2010/0108331 A1 5/2010 Ramsey et al.
2012/0217017 A1 * 8/2012 Zediker ..... E21B 17/085 166/358
2014/0034316 A1 * 2/2014 Larson ..... E21B 29/08 166/298
2014/0190701 A1 7/2014 Humphreys
2015/0083943 A1 3/2015 Shah et al.
2016/0053565 A1 * 2/2016 Dhuet ..... E21B 33/063 166/339
2016/0186524 A1 * 6/2016 Faircloth ..... E21B 33/064 166/361
2017/0009549 A1 * 1/2017 Bhatnagar ..... E21B 33/062
2017/0314358 A1 11/2017 Givens et al.
2019/0063175 A1 2/2019 Papadimitriou et al.
2019/0145217 A1 * 5/2019 Alsup ..... E21B 33/076 166/339
2020/0032609 A1 * 1/2020 Guidry ..... E21B 33/072

FOREIGN PATENT DOCUMENTS

WO 2009157772 A1 12/2009
WO 2014/009703 A2 1/2014
WO 2017/069635 A1 4/2017
WO 2017/100311 A1 6/2017

OTHER PUBLICATIONS

Written Opinion issued in corresponding International Application No. PCT/US2020/037140, dated Dec. 11, 2020 (6 pages).

* cited by examiner

MULTI-INTERVENTION BLOWOUT PREVENTER AND METHODS OF USE THEREOF

BACKGROUND

Exploration for, location of, and extraction of subterranean fluids, including hydrocarbon fluids, typically involves drilling operations to create a well. Drilling operations, particularly drilling operations involving rotary drilling, often utilize drilling fluids, also called muds, for a variety of reasons including lubrication, removal of cuttings and other matter created during the drilling process, and to provide sufficient pressure to ensure that fluids located in subterranean reservoirs do not enter the borehole, or wellbore, and travel to the surface of the earth. Fluids located in subterranean reservoirs are under pressure from the overburden of the earth formation above them. Specialized equipment is used to provide control of all fluids used or encountered in the drilling of a well.

Conventionally, well pressure control equipment may include a blowout preventer (BOP). BOPs are a specialized valve or similar mechanical device, used to seal, control and monitor oil and gas wells to prevent blowouts, the uncontrolled release of crude oil or natural gas from a well. In conventional methods, operation specific BOPs form a BOP stack that sits atop of a wellhead. The operation specific BOPs in the BOP stack may include ram BOP(s) or annular BOP(s) for specific operations. Typically, ram BOP(s) or annular BOP(s) is a large valve that may be closed if the well loses control of formation fluids. By closing this valve (usually operated remotely via hydraulic actuators), the well may regain control of the reservoir. BOPs come in a variety of styles, sizes and pressure ratings. Some can effectively close over an open wellbore, some are designed to seal around tubular components in the well (drill pipe, casing or tubing) and others are fitted with hardened steel shearing surfaces that can actually cut through tubular components.

During well operations, multiple services may be required including tubular components, slickline, and wireline intervention. Between each operation, multiple rig up and rig down of equipment associated with these operations are performed. There are different concerns as lifting operation will be required with frequent risks to the people involved. In addition, the operations take longer time for the repetitive rig-up, rig-down and pressure testing of each of the operation specific BOPs.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a multi-intervention blowout preventer with a body having a bore therethrough. Additionally, a first pair of ram blocks may be coupled to the body and include a ram, a catcher, and a blade operationally connected to the bore via a first pair of openings in the body, wherein the ram, the catcher, and the blade are configured to cut a flexible line extending through the bore while holding the flexible line. Further, a second pair of ram blocks may be coupled to the body and include a second pair of rams operationally connected to the bore via a second pair of openings in the body, the second pair of rams to seal around a tubular. Furthermore, a third pair of ram blocks may be coupled to the body and include a third pair of rams operationally connected to the bore via a third pair of openings in the body, the third pair of rams to seal the bore. The multi-intervention blowout preventer may also include a fourth pair of ram blocks coupled to the body including a fourth pair of rams operationally connected to the bore via a fourth pair of openings in the body, the fourth pair of rams to shear the tubular or flexible line. The multi-intervention blowout preventer may further include a fifth pair of ram blocks coupled to the body including a fifth pair of rams operationally connected to the bore via a fifth pair of openings in the body, the fifth pair of rams to close on the flexible line. The multi-intervention blowout preventer may have a control panel configured to operate the first pair of rams, the second pair of rams, the third pair of rams, the fourth pair of rams, and the fifth pair of rams. The ram of the first pair of ram blocks may be configured to push the wireline or the slickline to a side in the bore. The catcher of the first pair of ram blocks may be configured to grab the wireline or the slickline. The blade of the first pair of ram blocks may be configured to cut the wireline or the slickline at a position above where the catcher holds the wireline or the slickline.

In another aspect, the embodiments disclosed herein relate to a ram apparatus for a blowout preventer that may include a first ram block having a first cavity connected to a first opening and a second cavity connected to a second opening; and a second ram block to be positioned in opposed relation to the first ram block with a passage defined between the first ram block and the second ram block, the second ram block having a third cavity connected to a third opening and an access port to provide external access to the passage. A ram may be disposed in the first cavity and configured to extend and retract through the first opening. The ram may be extendible into the passage to push a flexible line in the passage. A blade may be disposed in the second cavity and configured to extend and retract through the second opening. The blade may be extendible into the passage to cut the flexible line in the passage. A catcher may be disposed in the third cavity and configured to extend and retract through the third opening. The catcher may be extendible into the passage to catch the flexible line in the passage. Additionally, the ram may include a contact surface made of an elastomer or hard rubber to contact the flexible line. The catcher may include a clamp to lock around the flexible line. The blade may include a cutting surface and the cutting surface may be diamond coated. The second ram block may include a fourth cavity connecting the access port to the passage.

In yet another aspect, the embodiments disclosed herein relate to a method for operating a multi-intervention blowout preventer coupled to a wellhead. The method may include actuating a ram within a first pair of ram blocks to extend into a bore of the multi-intervention blowout preventer; engaging, with the ram, a flexible line running within the bore; actuating a catcher within the first pair of ram blocks and grabbing the flexible line with the catcher; actuating a blade within the first pair of ram blocks to extend into the bore; cutting, with the blade, the flexible line; and holding, with the catcher, the flexible line to hang within the bore. The method may also include retrieving the flexible line with a retrieving tool via an access port in the first pair of ram blocks. Additionally, the holding of the flexible line may include locking a clamp of the catcher on the flexible line. The method may further include actuating a second pair of rams within a second pair of ram blocks to extend into the bore and close on the flexible line; actuating a third pair of rams within a third pair of ram blocks to extend into the bore and seal the bore; actuating a fourth pair of rams within a fourth pair of ram blocks to extend into the bore and shear a tubular running within the bore; and actuating a fifth pair of rams within a fifth pair of ram blocks to extend into the bore and seal around the tubular.

Other aspects and advantages will be apparent from the following description and the appended claims.

DETAILED DESCRIPTION

Figure 1:
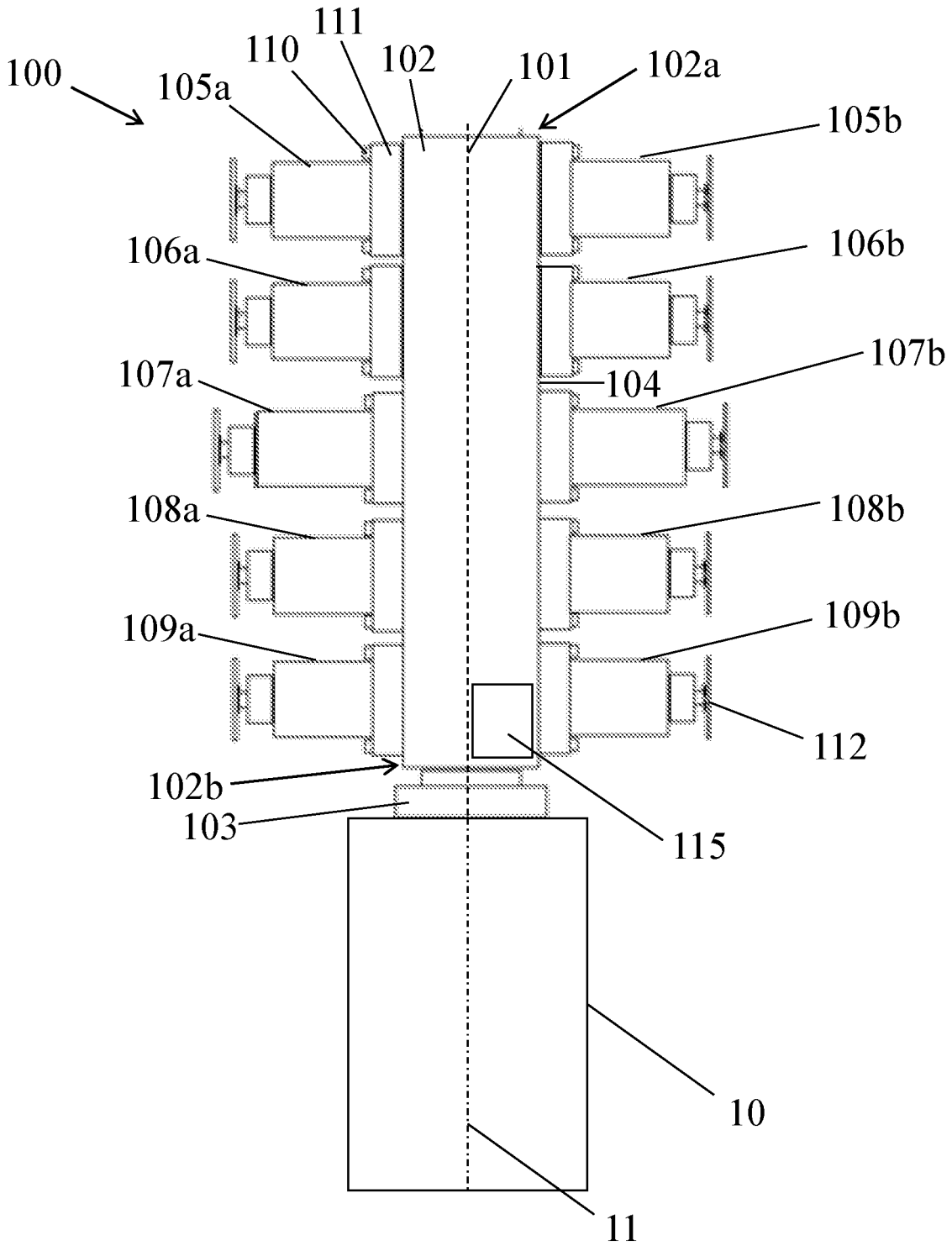
FIG. 1 illustrates a side view of a multi-intervention blowout preventer according to one or more embodiments of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification. In addition, any terms designating ram or ram block (i.e., a single or a pair of actuating rods with a contact surface) should not be deemed to limit the scope of the disclosure. As used herein, tubulars may refer to any string of tubulars that connect end-to-end such as, but not limited to, drill pipe, casing, or production strings. As used herein, wireline may refer to single-strand or multistrand wire or cable for intervention operations in oil or gas wells. Additionally, the wireline may be an electrical cable to lower tools into the well and transmit data for logging. As used herein, slickline may refer to a single-strand wireline or a nonelectric cable for running and retrieving tools within the well. The term "flexible line" may be used to generically refer to wireline and slickline. As used herein, fluids may refer to slurries, liquids, gases, and/or mixtures thereof. It is to be further understood that the various embodiments described herein may be used in various stages of a well, such as rig site preparation, drilling, completion, abandonment etc., and in other environments, such as work-over rigs, fracking installation, well-testing installation, oil and gas production installation, without departing from the scope of the present disclosure.

The different embodiments described herein provide a multi-intervention blowout preventer (MIBOP) including an integration of operation specific BOPS into a single body. By integrating the operation specific BOPs into a single body, in one or more embodiments, the MIBOP of the present disclosure may hold and cut equipment for retrieval, seal off an annulus between tubulars and a wellbore, seal off the wellbore when there are no tubulars in therein, shear equipment (e.g., tubulars, wireline, and slickline) therein, and/or maintain a seal around tubulars during rotation and stripping in/out in well control situation. The MIBOP may be used on and off in various stages of the well's life for pressure control and safety. The MIBOP as a single piece equipment may be installed, for example, at a wellhead in the place of a conventional BOP stack.

FIG. 1 shows a multi-intervention blowout preventer (MIBOP) 100 according to one or more embodiments. The MIBOP 100 is attached to a top of a wellhead 10. The wellhead 10 may be any device for providing a structural and pressure-containing interface with a well. For example, the wellhead 10 may be used for suspending and sealing casing strings within the well. Additionally, the MIBOP 100 may have a central axis 101 coaxial with an axis 11 of the wellhead 10. The MIBOP 100 may have a single body 102 vertically extending from a first end 102*a* to a second end 102*b* about the central axis 101. The single body 102 may have a bore therethrough extending along the central axis 101. The bore allows for tubulars, wireline, and slickline to travel through the MIBOP 100 and into the wellhead 10. At the second end 102*b*, a lower adaptor 103 may be provided to allow for connection of the MIBOP 100 to the wellhead 10.

In one or more embodiments, MIBOP 100 includes multiple pairs of ram blocks attached to an outer surface 104 of the single body 102. In a non-limiting example, a first pair of ram blocks 105*a*, 105*b*, a second pair of ram blocks 106*a*, 106*b*, a third pair of ram blocks 107*a*, 107*b*, a fourth pair of ram blocks 108*a*, 108*b*, and a fifth pair of ram blocks 109*a*, 109*b* may be secured to the outer surface 104 of the single body 102. As an example, bolts 110 may removably attach each ram block 105*a*-109*b* via a connection flange 111 to the outer surface 104 of the single body 102. Although MIBOP 100 is shown as having five pairs of ram blocks, MIBOP 100 may generally have two or more pairs of ram blocks. In one or more embodiments, at least one of the pairs of ram blocks in MIBOP 100 is a catch-shear-seal ram as described in FIGS. 2A-2E. The catch-shear-seal ram may prevent the loss of tools downhole and avoid fishing operations. In a non-limiting example, the catch-shear-seal ram may hold a wireline and/or a slickline therein before cutting the wireline and/or the slickline. Additionally, the catch-shear-seal ram may cut the wireline and/or the slickline above a point where the catch-shear-seal ram is holding the wireline and/or the slickline. Further, the catch-shear-seal ram may have an access port to allow for retrieval of the wireline and/or the slickline.

In some embodiments, while at least one of the pairs of ram blocks 105*a*-109*b* may be catch-shear-seal ram, the other pairs of ram blocks 105*a*-109*b* may be any type of ram, such as a pipe/slip ram, a shear ram, a blind ram, or a ram to close on both the wireline and the slickline. In one non-limiting example, ram blocks 105*a*, 105*b* may variable bore pipe rams to hold and close around flexible lines (wirelines or slicklines) of various sizes; ram blocks 106*a*, 106 may be catch-shear-seal rams to catch and shear a flexible line (wireline or slickline) and seal a wellbore; ram blocks 107*a*, 107*b* may be blind rams to seal a wellbore; ram blocks 108*a*, 108*b* may be shear rams to shear a tubular (e.g., coiled tubing) or flexible line (wireline or slickline); and ram blocks 109*a*, 109*b* may be pipe or slip rams to hold and close around a tubular (e.g., a coiled tubing). The positions of the ram blocks in the stack may be as shown in FIG. 1 or may be different. Ram blocks 105*a*-109*b* may be similar to a gate valve having a pair of opposing rams. It is further envisioned that an annular preventer may also be integrated into the MIBOP 100. The annular preventer may be a large valve used to control wellbore fluids. In the annular preventer, a sealing element is provided and resembles a large rubber doughnut that is mechanically squeezed inward to seal on either a tubular or close an open hole.

As shown in in FIG. 1, each of the pairs of ram blocks 105*a*-109*b* may have a first ram block 105*a*, 106*a*, 107*a*, 108*a*, 109*a* facing a second ram block 105*b*, 106*b*, 107*b*, 108*b*, 109*b* at opposite sides of the single body 102. Additionally, each of the first ram block 105*a*, 106*a*, 107*a*, 108*a*, 109*a* and the second ram block 105*b*, 106*b*, 107*b*, 108*b*, 109*b* may be perpendicular to central axis 101. Further, each of the pairs of ram blocks 105*a*-109*b* may be evenly spaced from each other starting from the first end 102*a* to the second end 102*b* of the single body 102. While it is noted that five pairs of ram blocks 105*a*-109*b* are shown in FIG. 1, the MIBOP 100 may have any number of pairs of ram blocks without departing from the scope of the present disclosure. It is further envisioned that each of the first ram block 105*a*, 106*a*, 107*a*, 108*a*, 109*a* and the second ram block 105*b*, 106*b*, 107*b*, 108*b*, 109*b* may have a wheel 112 attached to a distal end opposite the outer surface 104 of the single body 102. The wheel 112 may allow for manual actuation of each of the pairs of ram blocks 105*a*-109*b*.

In one or more embodiments, the MIBOP 100 may have a control panel 115. The control panel 115 may be a computing system for implementing methods disclosed herein. The control panel 115 may include one or more computer processors, non-persistent storage (e.g., volatile memory, such as random access memory (RAM), cache memory), persistent storage (e.g., a hard disk, an optical drive such as a compact disk (CD) drive or digital versatile disk (DVD) drive, a flash memory, etc.), a communication interface (e.g., Bluetooth interface, infrared interface, network interface, optical interface, etc.), and numerous other elements and functionalities. Additionally, the control panel 115 may include an human machine interface ("HMI") using a software application and may be provided to aid in the automation of the MIBOP 100. The HMI may include a screen, such as a touch screen, used as an input (e.g., for a person to input commands) and output (e.g., for display) of the computing system. In some embodiments, the HMI may also include switches, buttons, knobs, joysticks and/or other hardware components which may allow an operator to interact through the HMI with the MIBOP 100. Additionally, the human machine interface may have wireless communications such that a user from remote location may operate the MIBOP 100.

Additionally, a plurality of sensors (not shown separately) may be provided on and within the MIBOP 100 to communicate with the control panel 115. In a non-limiting example, the plurality of sensors may be a microphone, ultrasonic, ultrasound, sound navigation and ranging (SONAR), radio detection and ranging (RADAR), acoustic, piezoelectric, accelerometers, temperature, pressure, weight, position, or any sensor in the art to detect and monitor the one or more pairs of ram blocks 105*a*-109*b*. Additionally, the plurality of sensors may be any sensor or device capable of wireline/slickline monitoring, valve monitoring, and equipment performance and damage. The plurality of sensors may be used to collect data on status, process conditions, performance, and overall quality of the MIBOP 100, for example, on/off status of equipment, open/closed status of valves, pressure readings, temperature readings, and others. One skilled in the art will appreciate the plurality of sensors may aid in detecting possible failure mechanisms in individual components, approaching maintenance or service, and/or compliance issues. In some embodiments, the plurality of sensors may transmit and receive information/instructions wirelessly and/or through wires attached to the plurality of sensors.

FIGS. 2A-2E show an exemplary catcher-shear-seal ram 200 that may be included in MIBOP 100 (in FIG. 1). The catcher-shear-seal ram 200 may include a first ram block 201 attached to a first outer surface 104*a* of the single body 102 and a second ram block 202 attached to a second outer surface 104*b* of the single body 102. The first ram block 201 and the second ram block 202 may face each other opposite a bore 113 extending therethrough the single body 102. Both the first ram block 201 and the second ram block 202 may be in communication with the bore 113 via openings 203*a*, 203*b*, 203*c*, 203*d* in the single body 102. Each opening 203*a*, 203*b*, 203*c*, 203*d* in the single body 102 may have an actuating door (not shown) to open and close each opening 203*a*, 203*b*, 203*c*, 203*d*.

In one or more embodiments, the first ram block 201 may have a first cavity 201*a* and a second cavity 201*b*. In the first cavity 201*a*, a first actuation device 204, such as a hydraulic piston, may be provided. The first actuation device 204 may be connected to a surface of the first cavity 201*a* at an end opposite the first opening 203*a* of the single body 102. At an end approximate the first opening 203*a*, a ram 205 may be connected to the first actuation device 204. The ram 205 may be made of a metal or steel. The ram 205 may have a contact surface 206 for interacting with a wireline or slickline 114. The contact surface 206 may include an area 207 made from an elastomer or hard rubber to avoid breaking or cutting the wireline or slickline 114. In the second cavity 201*b*, a second actuation device 208, such as a hydraulic piston, may be provided. The second actuation device 208 may have be connected to a surface of the second cavity 201*b* at an end opposite the second opening 203*b* of the single body 102. At an end approximate the second opening 203*b*, a blade 209 may be connected to the second actuation device 208. The blade 209 may have a cutting surface 210 to cut the wireline or slickline 114. The blade 209 may be made of metal or steel material hard enough to cut through the wireline or slickline 114. The cutting surface 210 may be diamond coated or have resilient material to increase durability and cutting performance. In some embodiments, the first cavity 201*a* and the second cavity 201*b* may be integrated together to form a single cavity for both the ram 205 and the blade 209.

In some embodiments, the second ram block 202 may have a first cavity 202*a* and a second cavity 202*b*. A third actuation device 211, such as a hydraulic piston, may be provided in the first cavity 202*a*. The third actuation device 211 may be connected to a surface of the first cavity 202*a* at an end opposite the third opening 203*c* of the single body 102. At an end approximate the third opening 203*c*, a catcher 212 may be connected to the third actuation device 211. The catcher 212 may include a clamp 213 for grabbing the wireline or slickline 114. In the second cavity 202*b*, an access port 214 may be provided. The access port 214 may be used to retrieve the wireline or slickline 114 from the catcher 212. Additionally, a latch or door 214*a* may be used to close the access port 214.

Figure 2A:
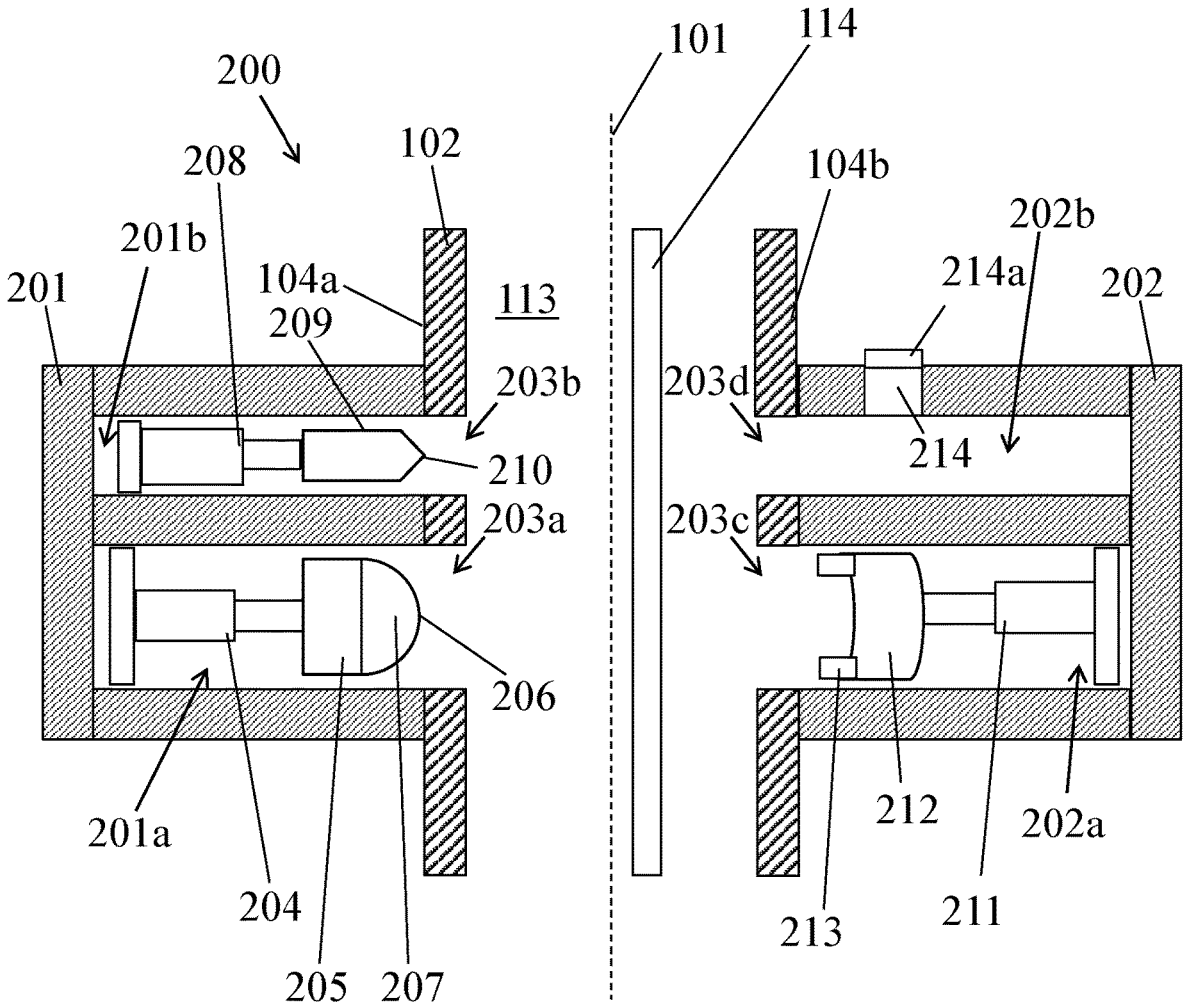
FIGS. 2A-2E illustrate a cross-sectional view, taken along a vertical plane of FIG. 1, of a BOP including a shear/seal catcher ram according to one or more embodiments of the present disclosure.
Figure 2B:
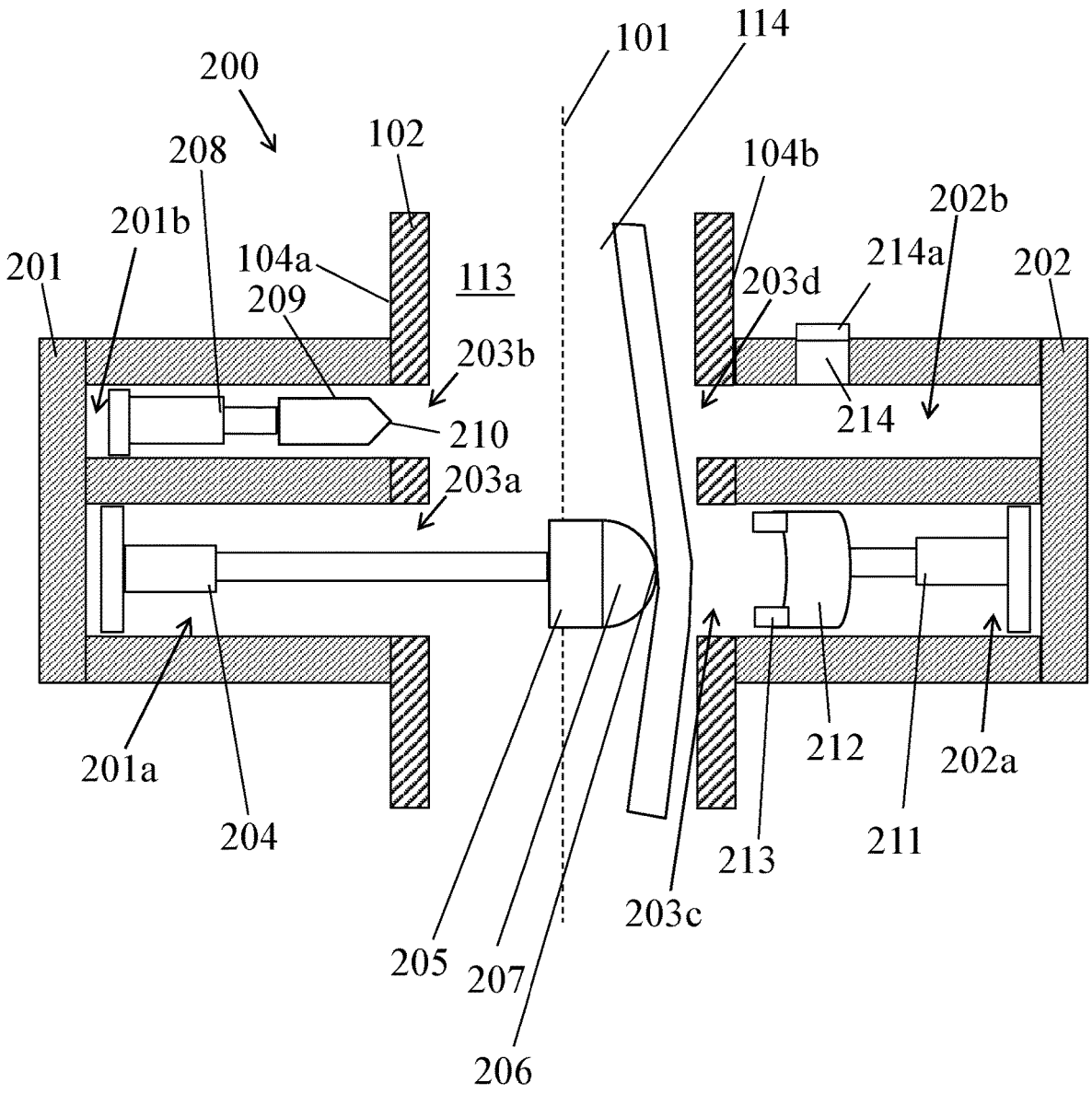
Figure 2C:
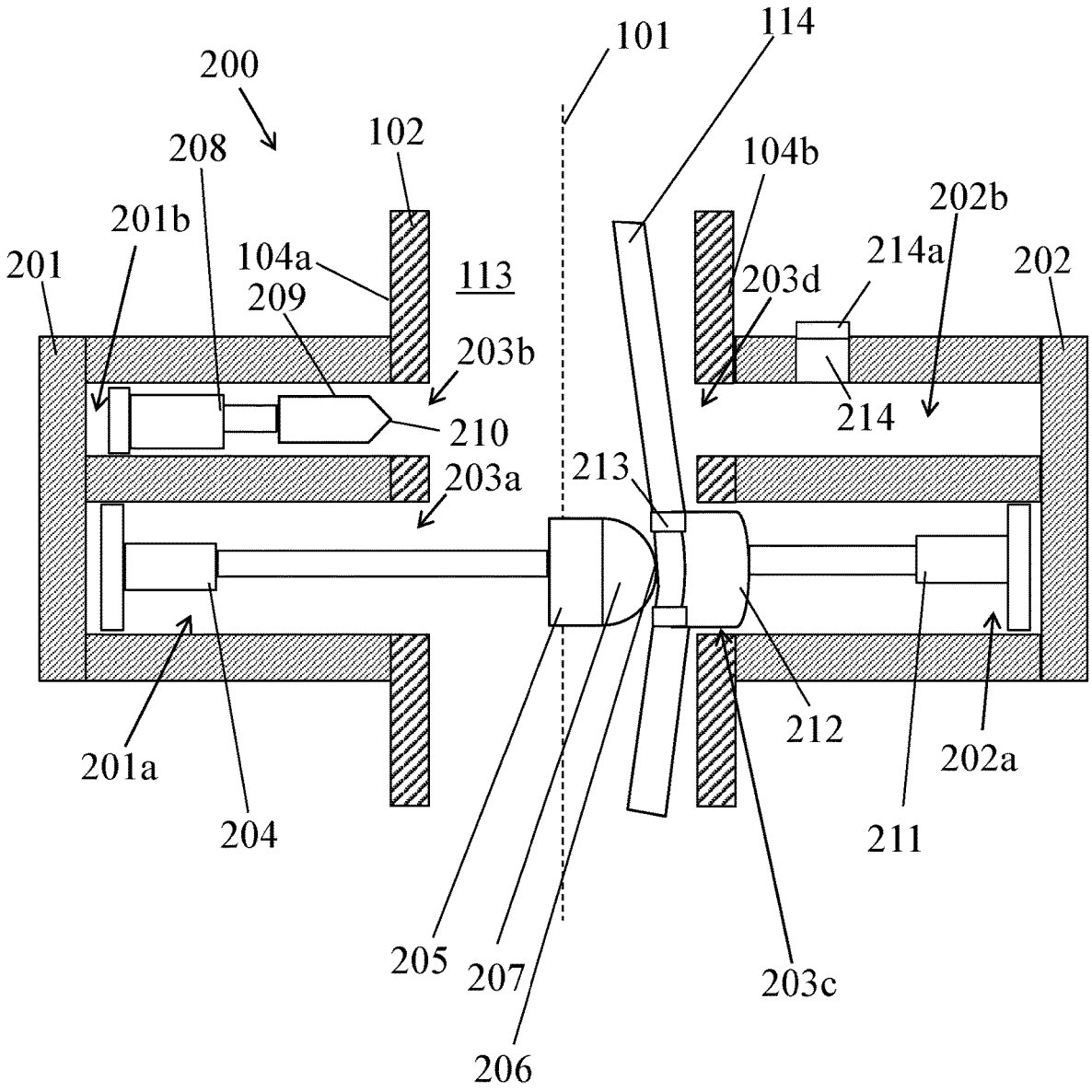
Figure 2D:
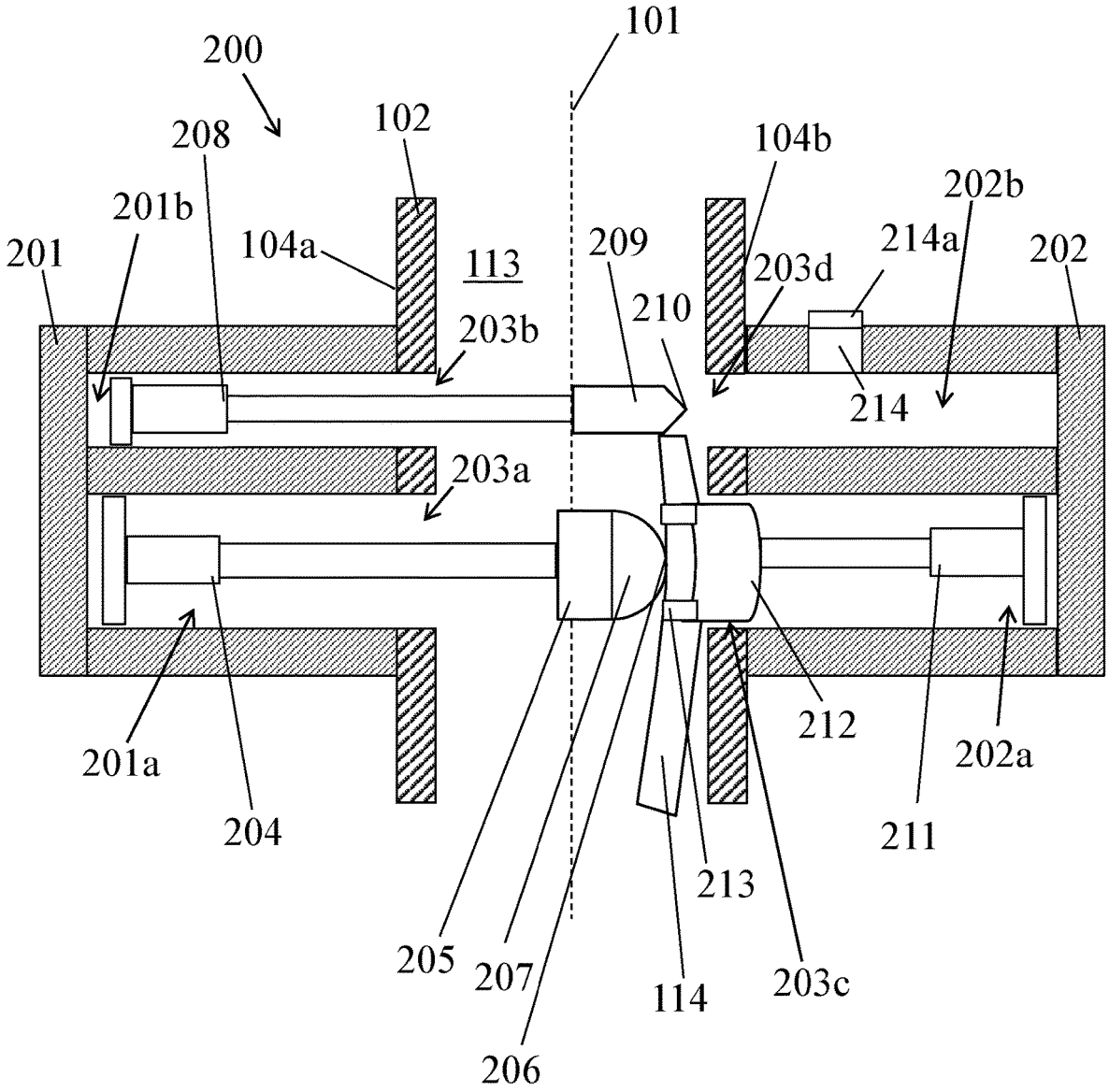

Now referring to FIG. 2B, in one more embodiments, the first actuation device 204 may be actuated to extend the ram 205 into the bore 113 via the first opening 203*a*. As the ram 205 extends, the contact surface 206 comes into contact with and pushes the wireline or slickline 114 to a side of the bore 113. With the wireline or slickline 114 pushed to the side of the bore 113, the third actuation device 211 may be actuated. As shown in FIG. 2C, the third actuation device 211 extends the catcher 212 into the bore 113 such that the clamp 213 passes through the third opening 203*c* and grabs the wireline or slickline 114. The clamp 213 may have a locking device to lock closed on the wireline or slickline 114. Once the wireline or slickline 114 is secured to the catcher 212, the second actuation device 208 may actuate. As shown in FIG. 2D, the second actuation device 208 extends the blade 209 through the second opening 203*b* and into the bore 113. The blade 209 continues to extend such that the cutting surface 210 contacts the wireline or slickline 114. Upon contact, the cutting surface 210 may cut through the wireline or slickline 114. After cutting the wireline or slickline 114, the second actuation device 208 retracts the blade 209 back within the second housing 201*b* of the first ram block 201. With the wireline or slickline 114 cut, the catcher 212 prevents the wireline or slickline 114 from falling downhole. Further, the ram 205 may stay in the bore 113 to further aid the catcher 212 in holding the wireline or slickline 114.

Figure 2E:
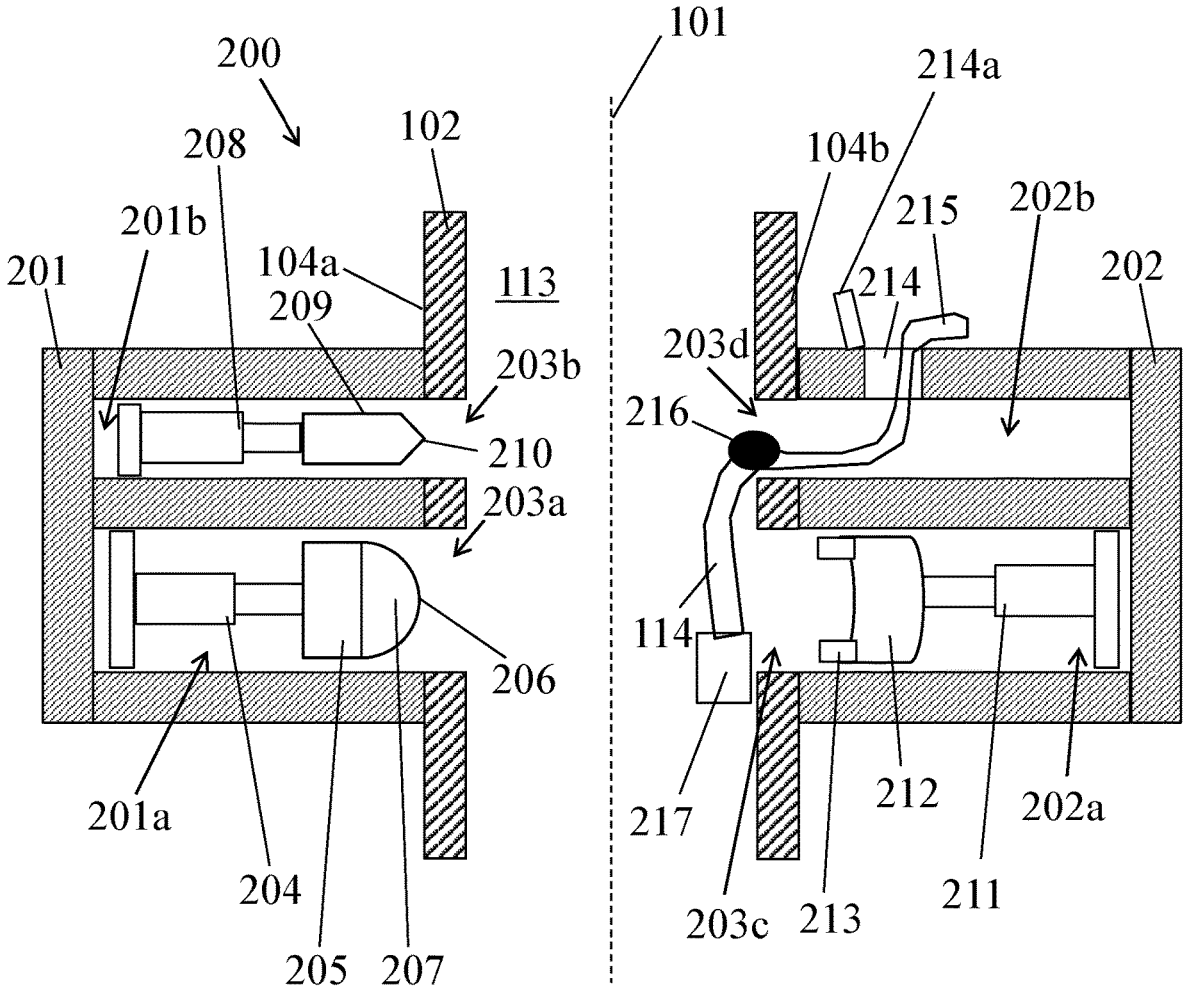

Now referring to FIG. 2E, with the wireline or slickline 114 cut and held by the catcher 212, the wireline or slickline 114 may now be retrieved. A retrieving tool 215 may be inserted into the second cavity 202*b* of the second ram block 202 via the access port 214 when the latch or door 214*a* is opened. A connection end 216 of the retrieving tool 215 may connect to the wireline or slickline 114. With the retrieving tool 215 connected to the wireline or slickline 114, the clamp 213 unlocks and releases the wireline or slickline 114 from the catcher 212 so that the third actuation device 211 retracts the catcher 212 back within the first housing 202*a* of the second ram block 202. The retrieving tool 215 may be now be operated to take the wireline or slickline 114 out of the bore 113. Further, a downhole tool 217 connected to the wireline or slickline 114 may also be retrieved and exit the bore 113 as the wireline or slickline 114 exits. By preventing the wireline or slickline 114 from falling downhole, the shear/seal catcher ram 200 aids in avoiding costly fishing operations and non-productive time (NPT) from having to shut down operations. Additionally, damage that may occur to downhole tool 217 connected to the wireline or slickline 114 may be avoided as the downhole tool 217 will no longer fall downhole. In some embodiments, the downhole tool 217 may be radioactive and may cause environmental damage if left downhole.

Figure 3:
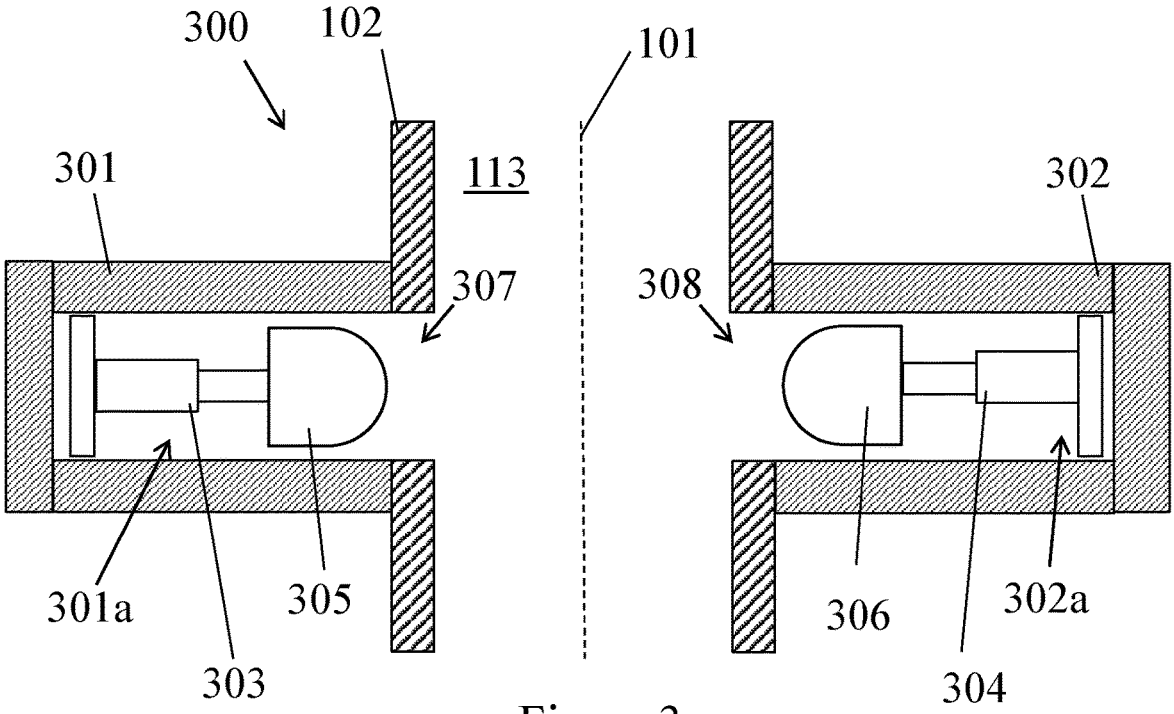
FIG. 3 illustrates a cross-sectional, taken along a vertical plane of FIG. 1, of a BOP including a pair of ram blocks according to one or more embodiments of the present disclosure.

FIG. 3 shows a type of ram block 300 that may be used in conjunction with the catch-shear-ram ram 200 (in FIGS. 2A-2E) in MIBOP 100 (in FIG. 1). The ram block 300 may include a first ram block 301 and a second ram block 302 attached to the single body 102. The first ram block 301 and the second ram block 302 face each other opposite the bore 113. The first ram block 301 and the second ram block 302 may each have a cavity 301*a*, 302*a* to house an actuation device 303, 304. The actuation devices 303, 304 may be hydraulic pistons. Additionally, a ram 305, 306 may be provided at ends of each actuation device 303, 304 approximate to respective openings 307, 308 in the single body 102. The actuation devices 303, 304 in the first ram block 301 and the second ram block 302 may actuate to extends the rams 305, 306 into the bore 113 for blowout preventer operations.

Figure 4A:
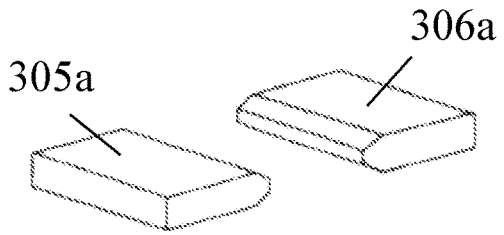
FIGS. 4A-4D illustrate perspective views of pairs of ram blocks with different ram profiles according to one or more embodiments of the present disclosure.
Figure 4B:
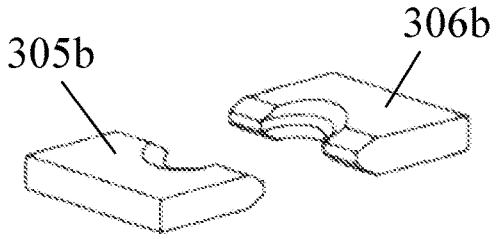
Figure 4C:
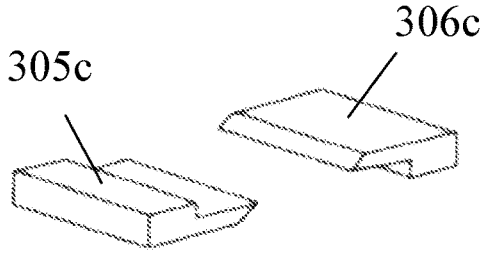
Figure 4D:
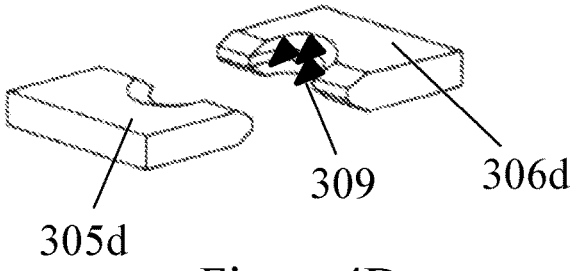

Non-limiting examples of the rams 305, 306 are shown in FIGS. 4A-4D to be used in various blowout preventer operations. If the type of ram block 300 of FIG. 3 is a blind ram, the rams 305, 306 may have a ram profile 305*a*, 306*a* as shown in FIG. 4A. As shown in FIG. 4A, the ram profile 305*a*, 306*a* may have a curved end to seal against each other. The blind ram may be used when the bore 113 is empty, for example, no tubulars, wireline, or slickline are within the bore 113. The blind ram closes the bore 113 to seal off well. If the type of ram block 300 of FIG. 3 is a pipe ram, the rams 305, 306 may have a ram profile 305*b*, 306*b* as shown in FIG. 4B. As shown in FIG. 4B, the ram profile 305*b*, 306*b* may have a curved end with a half-circle hole to seal against tubulars. The pipe ram may be used to close around tubulars, restricting flow in the annulus between the outside of the tubulars and the bore 113, but does not obstruct flow within the tubulars. Is it further envisioned that the ram profile 305*b*, 306*b* may be adjustable to accommodate any size of tubulars. If the type of ram block 300 of FIG. 3 is a shear ram, the rams 305, 306 may have a ram profile 305*c*, 306*c* as shown in FIG. 4C. As shown in FIG. 4C, the ram profile 305*c*, 306*c* may have offset blades to shear any equipment (e.g., tubulars, wireline, or slickline) within the bore 113. The offset blades may be metal to shear through the equipment (e.g., tubulars, wireline, or slickline) within the bore 113 and seal off the bore 113. If the type of ram block 300 of FIG. 3 is a slip/pipe ram, the rams 305, 306 may have a ram profile 305*d*, 306*d* as shown in FIG. 4D. As shown in FIG. 4D, the ram profile 305*d*, 306*d* may have a curved end with a half-circle hole to seal against tubulars. Additionally, teeth 309 may extend from a surface of the half-circle hole to secure against the tubulars and support the weight of tubulars. Further, the slip/pipe ram secure a movement of the tubulars and prevent the tubulars from being blown out of the bore 113. Is it further envisioned that the ram profile 305*d*, 306*d* may be adjustable to accommodate any size of tubulars. If the type of ram block 300 of FIG. 3 is a wireline/slickline ram, the rams 305, 306 may have a ram profile similar to the ram profile 305*b*, 306*b* as shown in FIG. 4B. The ram profile for the wireline/slickline ram may have a curved end with a half-circle hole to close around the wireline and slickline. Additionally, the half-circle hole may have a groove to fit the wireline and the slickline within.

Figure 5A:
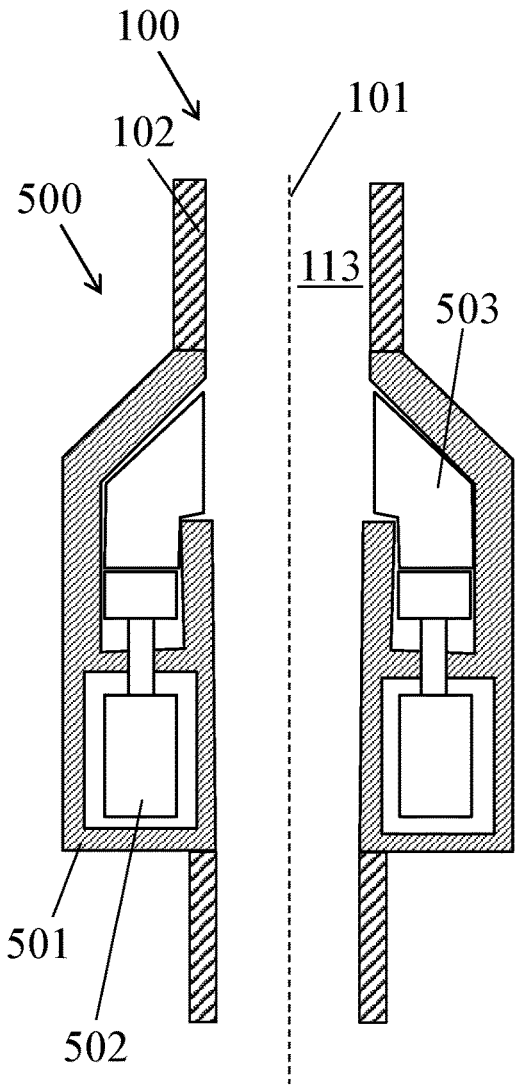
FIGS. 5A and 5B illustrate a cross-sectional view of an annular preventer according to one or more embodiments of the present disclosure.
Figure 5B:
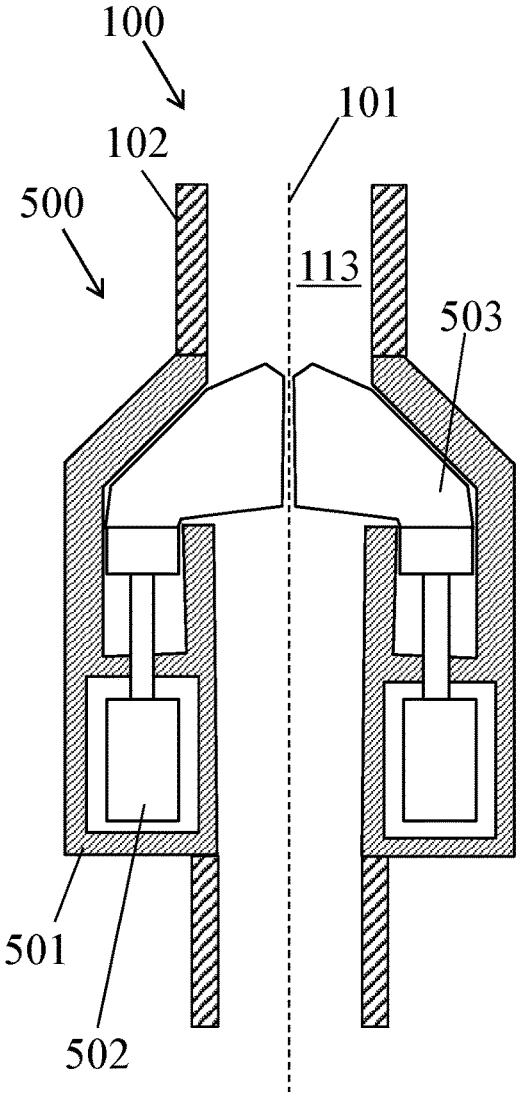

FIGS. 5A and 5B show an example of an annular preventer 500 that may be attached to the single body 102 of the MIBOP 100 according to one or more embodiments. The annular preventer 500 may have a seal block 501 around the bore 113. The seal block 501 may have an actuation device 502, such as a hydraulic piston. Additionally, a sealing element 503 may be provided in the seal block 501 and sit on top of the actuation device 502. The sealing element 503 may be made from an elastomer or rubber material. The sealing element 503 may have a shape of a doughnut. Once the actuation device 502 is actuated, the sealing element 503 is squeezed inward toward the central axis 101 within the bore 113. The sealing element 503 may seal on either tubulars or an open hole. In the case that the sealing element 503 seals against tubulars, the tubulars may be stripped in and out (i.e., moved vertically while pressure is contained below) of the bore 113. It is further envisioned that bearings may be provided between the sealing element 503 and the seal block 501 to allow for the sealing element 503 to rotate as the tubulars rotate.

Thus, there are a number of variations that may be made on the MIBOP of the present disclosure. The MIBOP may integrate a catcher-shear-seal ram disclosed herein with conventionally separate rams for various blowout preventer operations within a single body. By having such an integration, the MIBOP optimizes operation time and enhances safety as only one rig-up is required as only one MIBOP is need to be installed on the wellhead and used for tubulars, wireline, and slickline. As also described above, the catcher-shear-seal ram may eliminate the need for fishing operations after shearing the wireline or slickline. Overall, the MIBOP may minimize product engineering, risk associated with rig-ups, reduction of assembly time, hardware cost reduction, and weight and envelope reduction.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A multi-intervention blowout preventer comprising:

a body having a bore therethrough;

a first pair of ram blocks coupled to the body and comprising a ram, a catcher, and a blade operationally connected to the bore via a first pair of openings in the body, wherein the ram, the catcher, and the blade are configured to cut a flexible line extending through the bore while holding the flexible line and wherein the ram of the first pair of ram blocks is configured to push the flexible line to a side in the bore;

a second pair of ram blocks coupled to the body and comprising a second pair of rams operationally connected to the bore via a second pair of openings in the body, the second pair of rams to seal around a tubular; and a third pair of ram blocks coupled to the body and comprising a third pair of rams operationally connected to the bore via a third pair of openings in the body, the third pair of rams to seal the bore.

2. The multi-intervention blowout preventer of claim 1, further comprising a fourth pair of ram blocks coupled to the body and comprising a fourth pair of rams operationally connected to the bore via a fourth pair of openings in the body, the fourth pair of rams to shear the tubular or flexible line.

3. The multi-intervention blowout preventer of claim 2, further comprising a fifth pair of ram blocks coupled to the body and comprising a fifth pair of rams operationally connected to the bore via a fifth pair of openings in the body, the fifth pair of rams to close on the flexible line.

4. The multi-intervention blowout preventer of claim 3, further comprising a control panel configured to operate the first pair of rams, the second pair of rams, the third pair of rams, the fourth pair of rams, and the fifth pair of rams.

5. The multi-intervention blowout preventer of claim 1, wherein the catcher of the first pair of ram blocks is configured to grab the flexible line.

6. The multi-intervention blowout preventer of claim 5, wherein the blade of the first pair of ram blocks is configured to cut the flexible line at a position above where the catcher holds the flexible line.

7. A ram apparatus for a blowout preventer comprising:

a first ram block having a first cavity connected to a first opening and a second cavity connected to a second opening;

a second ram block to be positioned in opposed relation to the first ram block with a passage defined between the first ram block and the second ram block, the second ram block having a third cavity connected to a third opening and an access port to provide external access to the passage;

a ram disposed in the first cavity and configured to extend and retract through the first opening, the ram extendible into the passage to push a flexible line in the passage;

a blade disposed in the second cavity and configured to extend and retract through the second opening, the blade extendible into the passage to cut the flexible line in the passage; and a catcher disposed in the third cavity and configured to extend and retract through the third opening, the catcher extendible into the passage to catch the flexible line in the passage.

8. The ram apparatus of claim 7, wherein the ram comprises a contact surface made of an elastomer or hard rubber to contact the flexible line.

9. The ram apparatus of claim 7, wherein the catcher comprises a clamp to lock around the flexible line.

10. The ram apparatus of claim 7, wherein the blade includes a cutting surface.

11. The ram apparatus of claim 10, wherein the cutting surface is diamond coated.

12. The ram apparatus of claim 7, wherein the second ram block comprises a fourth cavity connecting the access port to the passage.

* * * * *